United States Patent [19]

Gochenour

[11] Patent Number: 4,580,683

[45] Date of Patent: Apr. 8, 1986

[54] HIGH SECURITY SELF-SEALING MAILING RECEPTACLE

[75] Inventor: Stanley R. Gochenour, Biglerville, Pa.

[73] Assignee: Jiffy Packaging Corp., Murray Hill, N.J.

[21] Appl. No.: 729,247

[22] Filed: May 1, 1985

[51] Int. Cl.[4] ..... B65D 33/20

[52] U.S. Cl. ..... 206/610; 206/521; 383/84

[58] Field of Search ..... 206/521, 610; 383/84, 383/91; 229/80

[56] References Cited

U.S. PATENT DOCUMENTS

| | | | |
|---|---|---|---|
| 2,475,236 | 7/1949 | Gollub | 383/84 |
| 2,952,398 | 9/1960 | Gerard | 206/521 |
| 3,592,380 | 7/1971 | Gerard | 206/521 |

FOREIGN PATENT DOCUMENTS

| | | | |
|---|---|---|---|
| 2601312 | 7/1976 | Fed. Rep. of Germany | 206/521 |
| 2295885 | 12/1974 | France | 383/84 |

*Primary Examiner*—Stephen P. Garbe

*Attorney, Agent, or Firm*—Mark T. Basseches; Paula T. Basseches

[57] ABSTRACT

A shipping enclosure in the nature of an envelope includes a sealing flap of greater width than the envelope adapted to be folded over the mouth of the envelope, the flap including extensions arranged to be bonded to the face of the envelope opposite the face defining the primary seal. A tear strip is interposed between the hinge connection of the flap to the envelope and the bond line for facilitating opening of the envelope, and for encircling and, hence, reenforcing the enclosure mouth prior to opening.

8 Claims, 8 Drawing Figures

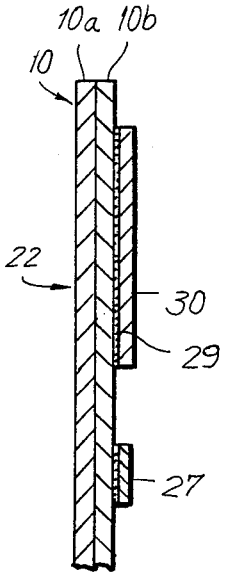
FIG.5
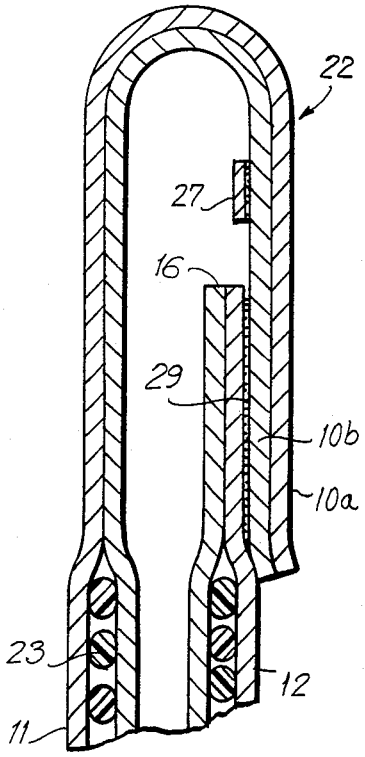
FIG.6
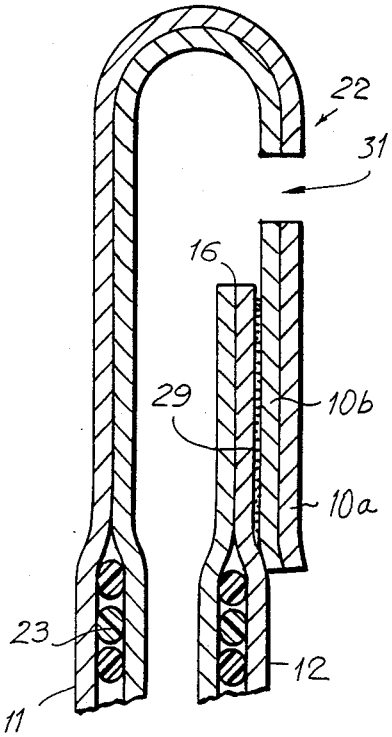
FIG.7
FIG.8
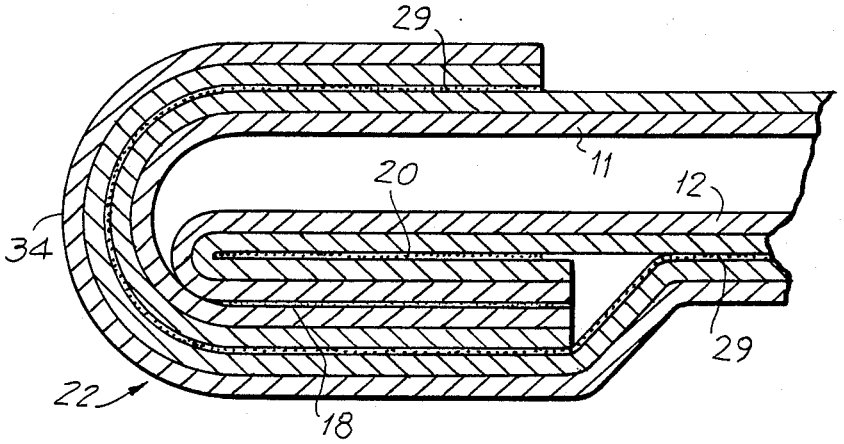

HIGH SECURITY SELF-SEALING MAILING RECEPTACLE

BACKGROUND OF THE INVENTION

The present invention is in the field of shipping containers in the nature of envelopes especially adapted for mailing and like uses, although the same is by no means restricted specifically thereto. More particularly, the invention is in the field of envelopes which may be readily sealed and are secured against dislodgement of the contents, yet may be readily opened by the recipient.

THE PRIOR ART

It is conventional to provide mailing envelopes, and especially mailing envelopes of the heavy duty padded type intended for the shipment of more or less frangible parts. Devices of the above noted type are shown in U.S. Pat. No. 3592,380, dated July 13, 1971, which is assigned to the assignee hereof.

Such devices typically include a mouth through which the user may insert articles to be shipped, the mouth being typically closed by folding the mouth defining walls and securing the folded-over components in position as by a line of staples, taping, etc. The taping or stapling mode of closure has been found objectionable by postal authorities since the projecting tines of the staples or flanges of the tape become entangled with other items of mail or with the automatic mail sorting equipment in current use. Additionally, where staples are relied upon as the closing media, projecting ends of the staples may snag the fingers of sorters or the recipients.

The use of staples is further disadvantageous in that unless the staples are carefully applied the same may pierce the contents of the shipping envelope, with resultant damage or with tearing of the documents when the same are removed.

While it is likewise conventional to supply glued flaps for sealing envelopes, such flaps are of relatively low security, particularly where the envelopes are employed in conjunction with bulky three dimensional contents which subject the glue joint to stresses other than in the plane of the glue layer.

SUMMARY OF THE INVENTION

The present invention may be summarized as directed to an improved shipping receptacle in the nature of an envelope specifically intended for the packaging of bulky articles or documents. In accordance with the invention an envelope is formed with a mouth portion defined by an opening between front and rear faces, which faces may be of multi-layer construction and may include therebetween padding material, such as an expanded foam or the like.

To one of the faces, which is hereinafter referred to as the front face, there is hingedly connected a flap member which projects upwardly beyond the front face. The longitudinal extent or dimension of the flap member exceeds that of the envelope.

A tear strip is mounted on the flap member at a position interposed between the hinge line and the upper edge of the flap. A pressure sensitive adhesive layer is formed across the entire longitudinal extent of the flap at a position between the tear strip and the upper edge of the flap, the layer being covered by a release strip.

The item is used by inserting the documents or objects to be shipped into the open mouth, removing the release strip, folding the flap over such that the now exposed pressure sensitive layer is engaged against and bonds to the outermost surface of the rear face of the device. Thereafter the projecting portions of the flap are folded so as to overlie the front face of the envelope and are pressed against the front face, whereby the flap member is secured not merely to the rear face but also includes components bonded to the front face of the envelope.

The noted construction is highly resistant to accidental or inadvertent opening, opening being effected by activating the tear strip.

As a result of activation of the tear strip, the envelope is preferably opened at all but a corner of the device whereat there remains an overlap portion so that the contents of the envelope are not likely to be inadvertently dislodged but may be readily manually removed.

Accordingly, it is an object of the present invention to provide an improved shipping container in the nature of an envelope which may be readily and securely sealed and which is highly resistant to inadvertent opening.

A further object of the invention is the provision of a shipping or mailing envelope of the type described having a closure flap which overlaps the mouth of the envelope in the sealed condition, the flap including extension portions which may be bonded to the face of the envelope opposite the face to which the primary seal is secured, whereby the envelope is rendered secure against inadvertent opening even where relatively bulky objects are disposed within the envelope.

Still a further object of the invention is the provision of a shipping device of the type described and including a tear strip adapted, when activated, to cut through the sealing flap substantially the length thereof while leaving a corner of the mouth of the envelope covered by an overlap portion of the flap, the envelope thus providing a degree of security against dislodgment of the contents even after opening.

Still a further object of the invention is the provision of an envelope of the type described wherein a high tensile strength tear strip extends substantially the length of the closure flap at the rear face of the envelope and encircles and is affixed to a portion of the front face, whereby the tear strip serves the function of reenforcing the mouth of the bag until it is opened in addition to the usual function of facilitating opening of the envelope.

To attain these objects and such further objects as may appear herein or be hereinafter pointed out, reference is made to the accompanying drawings, forming a part hereof, in which:

FIG. 5 is a magnified section taken on the line 5—5 of FIG. 1;

FIG. 6 is a magnified section taken on the line 6—6 of FIG. 4;

FIG. 7 is a magnified section taken on the line 7—7 of FIG. 4;

FIG. 8 is a magnified section taken on the line 8—8 of FIG. 4.

Figure 2:
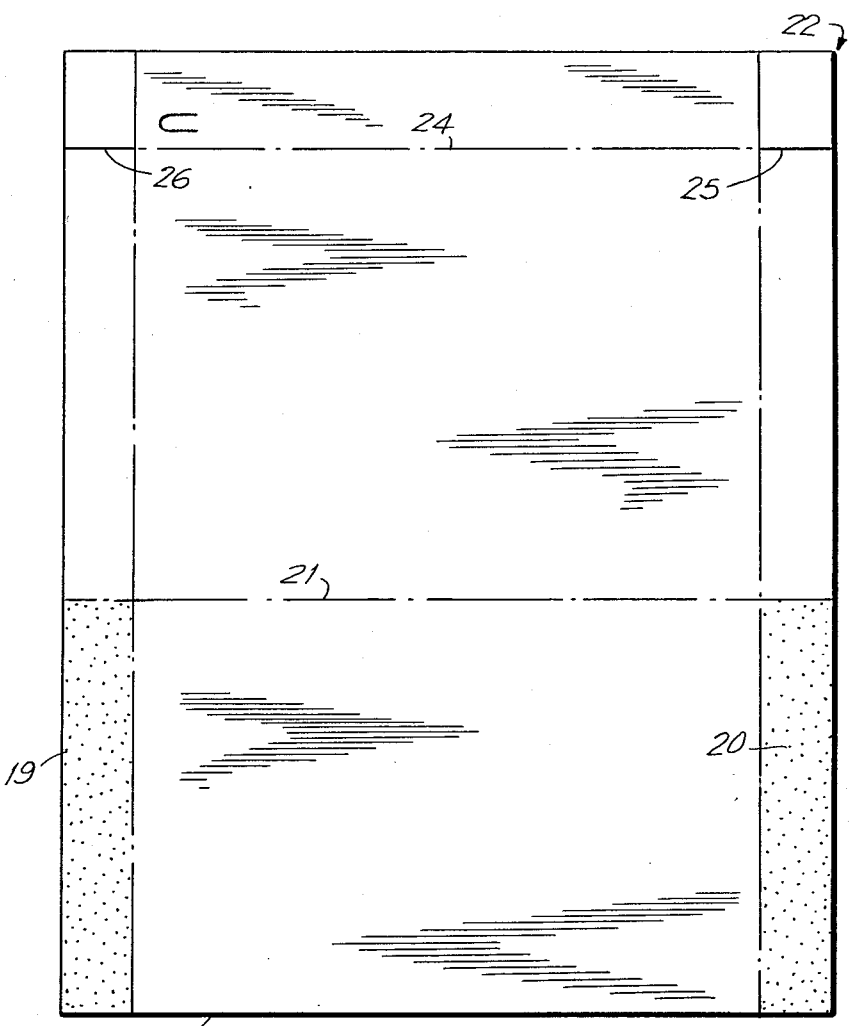
FIG. 2 is a view similar to FIG. 1 disclosing the outer surface of the envelope.
Figure 1:
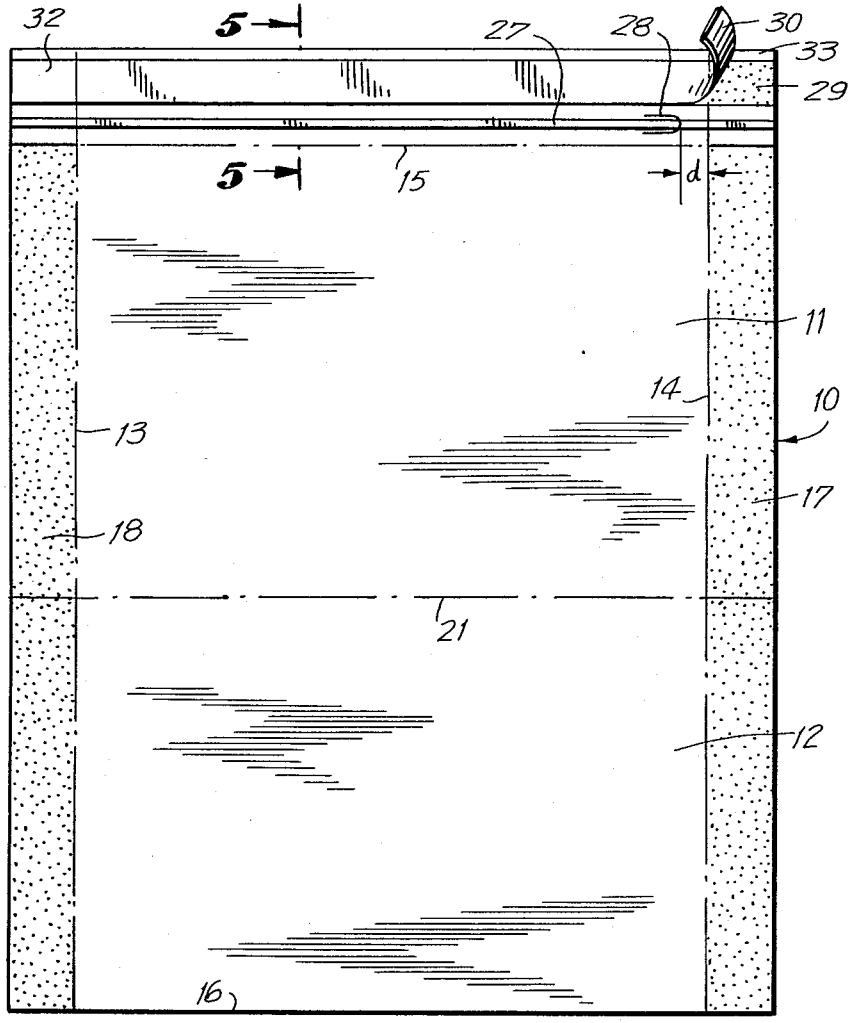
FIG. 1 is a plan view of a blank for forming an envelope in accordance with the invention depicting the inner or interior defining surface of the envelope.

Referring now to the various views, there is disclosed in FIG. 1 a blank or sheet 10 of Kraft paper or the like. While the sheet 10 may be comprised of a single layer, it is more usual and preferred to form the same of two or more layers, the areas 11 and 12 which will define the front and rear faces, respectively, of the finished envelope encompassing therebetween flatwise increments of padding material, such as an expanded foam, stuffing or the like.

It will be understood that the batting or foam is coextensive with the boundaries of the panels or faces 11, 12, i.e. does not extend beyond the side edges 13, 14 or above the upper edge 15 of the panel 11 or beyond the lower edge 16 of the panel 12. The inner face of the blank 10 includes vertically directed adhesive or glue coatings 17 and 18, the coatings extending from the margin 16 of panel 12 to the margin 15 of panel 11.

In addition the outer face of the blank 10 includes adhesive or glue strips 19 and 20 which extend from margin 16 up to a central fold line 21.

The adhesive coatings 17, 18, 19, 20 may comprise hot melt adhesive or the like progressively applied in the course of manufacture, but for purposes of clarity the adhesive has been illustrated as preapplied.

Projecting upwardly from the upper margin 15 of panel or face 11 is a sealing flap construction 22 which forms the principal advance of the instant device.

The sealing flap 22, which may be comprised of a double thickness of Kraft paper or the like utilized for the encompassing of the interior stuffing 23, is joined to the panel 11 at a fold line 24 coincident with the margin 15. A pair of inwardly directed slits 25, 26, also coincident with the fold line 24, is formed in the blank, the lengthwise extent of the slits being substantially identical to the transverse dimension or width of the adhesive lines 17 and 18.

As best seen in FIGS. 1 and 5 to 7, the flap 22 includes on its inner face a tear strip 27 which is preferably comprised of a flexible polymeric material of high tensile strength. The strip 27 extends across the entire width of the blank and includes a start tab portion 28 which comprises, in substance, a U-shaped slit extending through the thickness of the tear strip 27 and also paper layers 1O*a* and 1O*b* defining the blank 10.

The tear strip 27 is adhesively bonded to the flap 22 and, as will be best seen in FIG. 1, tab 28 is spaced a distance d from the margin line 14. In practice, a continuous strip of the polymeric material 27 is bonded to an extended length of paper forming a multiplicity of blanks, individual blanks being severed from the length, the same operation effecting severing of the polymeric strip.

The flap assembly 22 includes a pressure sensitive layer 29 extending the transverse dimension of the blank 10, the pressure sensitive layer incorporating a release paper covering 30 coextensive with the pressure sensitive layer. Optionallybut preferably, the pressure sensitive layer and release coated strip 30 are applied as a unit by affixing the pressure sensitive layer 29 which is prebonded to the release layer across the width of the envelope. The composite article, namely release paper and pressure sensitive coating, is readily available as a commercial article.

As will be understood, by virtue of the preferential adhesion of the pressure sensitive layer to the surface of the blank 10 as opposed to the release paper 30, after application of the composite strip the release paper may be readily removed when the envelope is to be used, leaving the adhesive layer in position on flap structure 22.

The blank 10 is assembled by first folding the blank inwardly about hinge line 21 so as to cause the adhesive coated areas 17 and 18 to opposite sides of the line to be bonded to each other.

It will be readily appreciated that the adhesive may be of any selected type suitable for securing the layers of the blank, the selected adhesive being chosen in accordance with compatability to the material of the blank. The adhesive may be preapplied to the blank or may be applied in situ progressively as the blank is being formed, the latter being the typical procedure in production.

After the interbonding of the adhesive layers 17 and 18, the flaps defined between slits 25, 26 on the one hand and hinge line or enclosure bottom 21 on the other are folded such that the adhesive portions 19 and 20 line against and are bonded to the outer surface of the rear panel 12 of the envelope.

The adhesive employed in respect of the areas 19 and 20 may be the same as that used for portions 17, 18.

Figure 3:
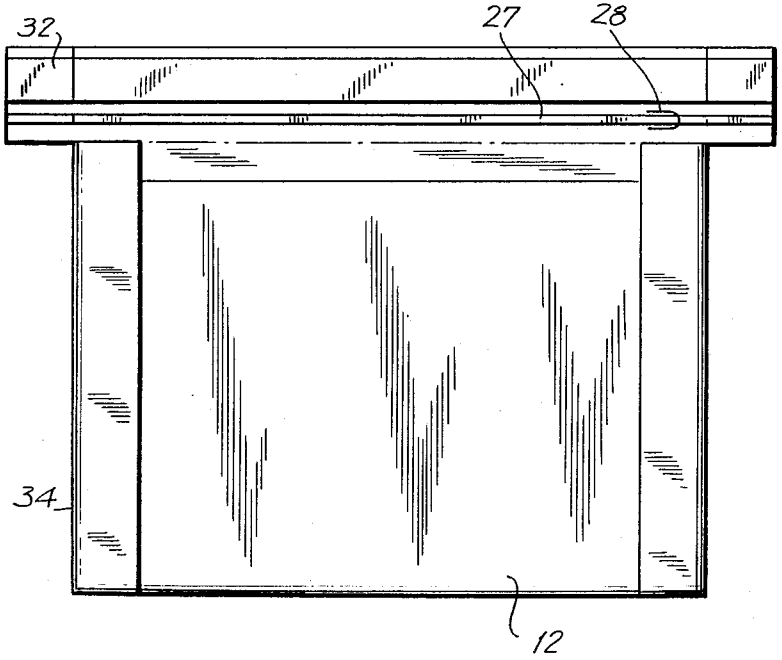
FIG. 3 is a view of the rear of a completed envelope prior to sealing thereof.

The assembled envelope is depicted in FIG. 3.

In use, an article is inserted through the mouth portion 31 defined between the front and rear panels 11 and 12. Thereafter the release strip 30 is removed and the closure flap construction 22 which is hinged to the front face of the device is folded rearwardly so as to bring the pressure sensitive layer 29 into contact with the outer face of the rear panel or face 12. Thereafter laterally projecting portions 32, 33 of the closure flap structure 22 are folded forwardly so as to bond against the front or outer face of the front panel 11—see FIG. 8.

Figure 4:
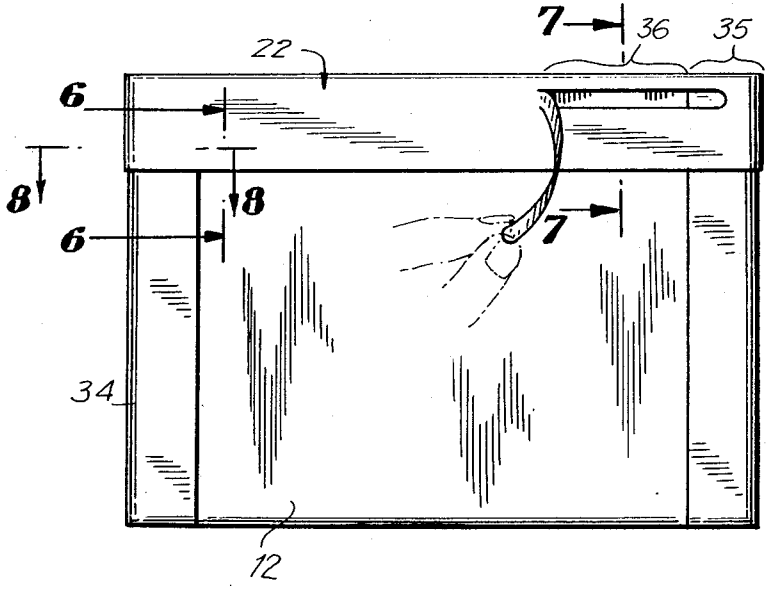
FIG. 4 is a plan view of the rear of the envelope after sealing and in the course of opening thereof.

The fully sealed envelope is depicted in plan in FIG. 4. It will be noted that by bonding portions 32, 33 to the front face of the envelope, portions of the high tensile strength tear strip are also bonded to the front face thereby the tear strip material laps both end margins of the envelope.

As will be apparent from the preceding description, closure of the envelope has been effected by a bonding of the closure flap 22 to the rear face of the envelope and, in addition, by a bonding of the extensions 32, 33 to the front face of the envelope. The resulting envelope evinces a high degree of security against inadvertent opening even when the same has been filled with a bulky article which tends to stress the panels 12 and 11 apart. This security is, in a measure, engendered by the encircling of the end margins by the tear strip.

When it is desired to open the envelope, the tab 28 of the tear strip 27 is grasped and pulled, whereupon the tear strip rips through the coincident portions of the flap 22. Since the tear strip extends from a position adjacent to but spaced from margin 14 entirely around the envelope, including the closure tab 32, activation of the tear strip will result in an opening of the entire envelope from the position beginning at the tab 28 to a position which circles the lefthandmost margin 34 of the envelope and around to the front of the envelope.

Notwithstanding activation of the tear strip, the area 35, which is laterally outwardly located relative to the tab 28, will remain closed, with the result that a curl or increment 36 of the closure flap adjacent the area 35 will remain in partially overlapping relation of the envelope, the degree of overlap being progressively reduced as the distance from the area 35 increases.

Moreover, since the tear strip, when fully activated, will separate the entirety of the extension 32, it will be appreciated that the lefthandmost side of the envelope (viewed in the orientation of FIG. 4) will be fully opened whereas the right hand side will include a minor hooding defined by the remaining increments of the closure flap 22.

This hooding, while presenting no obstacle to an intentional removal of documents or like materials from the opened envelope, affords a degree of assurance against inadvertent displacement of the contents.

As wi11 be apparent from the preceding disclosure, there is formed in accordance with the invention a readily sealed and readily opened envelope or shipping container which is inexpensive and simple to manufacture on conventional production equipment. By virtue of the novel closure arrangement, the envelope affords a high degree of security against opening even if the same is subjected to separating forces. The envelope may be sealed without the use of external tapes, staples or the like and thus conforms to the pertinent postal regulations.

While the device of the invention has been illustrated as a double-walled bag or envelope wherein padding materials is interposed between the double wall components, it will be readily recognized that where shock protection is not necessary, the padding material may be eliminated and a single thickness construction employed.

As will be evident to skilled workers in the art familiarized with the instant disclosure numerous details of construction may be modified without departing from the spirit of the invention which is embodied in the "best mode" herein illustrated, Accordingly the invention is to be broadly construed within the scope of the appended claims.

Having thus described the invention and illustrated its use, what is claimed as new and is desired to be secured by Letters Patent is:

1. A mailing device or the like comprising an envelope having a front and a rear face, said front and rear faces being connected at bottom and side edges, said rear face being of lesser vertical extent than said front face, said envelope including a mouth portion defined between the inner surface of said front face and the uppermost margin of said rear face, a closure flap defined by an upward continuation of said front face, said closure flap being connected to said front face at a first hinge line coincident with the upper margin of said front face, said closure flap extending laterally in each direction beyond said side edges, a pressure sensitive adhesive layer on the inner surface of said closure flap extending entirely across said closure flap, a release strip removably secured to and covering said pressure sensitive layer, a tear strip formed on said closure flap, said tear strip being interposed between said first hinge line and said pressure sensitive layer, said envelope being sealable by removing said release strip, folding said closure flap over said mouth portion to bond portions of said pressure sensitive layer to said rear face, and thereafter folding the portions of said closure flap extending beyond said side edges into registry with said front face and bonding said extending portions to said front face.

2. A device in accordance with claim 1 wherein said tear strip begins at a point inwardly disposed with respect to one of said side edges and extends to a point at least coincident with said other side edge whereby, following sealing of said device and upon activation of said tear strip to open said device, at least a corner of said closure flap in registry with said one side edge remains in overlapping relation of said mouth portion.

3. A device in accordance with claim 2 wherein said tear strip comprises a length of high tensile strength material bonded to said inner surface of said closure flap.

4. A device in accordance with claim 3 and including a generally U-shaped tab portion formed through said closure flap in registry with said tear strip, said tab being positioned in proximate relation to said one side edge.

5. A device in accordance with claim 1, said device being fabricated from a generally rectangular blank, said front and rear faces being defined by a first transverse fold line forming said bottom edge, said closure flap being partially separated from the body of said blank by inwardly extending slits substantially coincident with said first hinge line, said slits terminating at positions substantially coincident with said side edges, said side edges of said device being formed by inwardly folded double layer portions of said blank extending from said bottom edge toward said first hinge line.

6. A device in accordance with claim 5 wherein said blank is formed of double thickness, the combination including padding material between said thicknesses in the area in registry with said front and rear faces.

7. A device in accordance with claim 1 wherein said tear strip comprises a length of high tensile strength material bonded to said inner surface of said closure flap, said material extending substantially entirely across said closure flap whereby, upon attachment of said extending portions of said closure flap, each of said side edges is encircled by a length of said high tensile strength material, said device including a cutout portion extending through said closure flap and said tear strip at a position in proximate relation to one of said side edges.

8. A mailing device or the like comprising an envelope having a front and a rear face, said front and rear faces being connected at bottom and side edges, said rear face being of lesser vertical extent than said front face, said envelope including a mouth portion defined between the inner surface of said front face and the uppermost margin of said rear face, a closure flap defined by an upward continuation of said front face, said closure flap being connected to said front face at a first hinge line coincident with the upper margin of said front face, said closure flap extending laterally in each direction beyond said side edges, a pressure sensitive adhesive layer on the inner surface of said closure flap extending entirely across said closure flap adjacent the end margin thereof, a release strip removably secured to and covering said pressure sensitive layer, a length of high tensile strength material fixedly bonded to said inner surface of said closure flap at a position parallel to and interposed between said first hinge line and said pressure sensitive layer, said material extending entirely across said closure flap, a cutout portion formed through said closure flap and said tear strip laterally inwardly of and in proximate relation to one of said side edges, said envelope being sealable by removing said release strip, folding said closure flap over said mouth portion to bond portions of said pressure sensitive layer to said rear face, and thereafter folding the portions of said closure flap extending beyond said side edges into registry with said front face about fold lines coincident with said side edges and bonding said extending portions to said front face.

* * * * *